US007077598B1

(12) United States Patent
Leonhardt et al.

(10) Patent No.: US 7,077,598 B1
(45) Date of Patent: Jul. 18, 2006

(54) BOLLARD AND METHOD OF MOUNTING

(75) Inventors: Michael Leonhardt, Castaic, CA (US); Tori C. Poppenheimer, La Canada-Flintridge, CA (US); David Crookham, Valencia, CA (US)

(73) Assignee: Acuity Brands, Inc., Atlanta, GA (US)

( * ) Notice: Subject to any disclaimer, the term of this patent is extended or adjusted under 35 U.S.C. 154(b) by 0 days.

(21) Appl. No.: 11/213,666

(22) Filed: Aug. 25, 2005

(51) Int. Cl.
*G09F 15/00* (2006.01)

(52) U.S. Cl. ..... 404/9; 40/606.01; 40/607.01; 40/612; 40/607.1; 116/63 R

(58) Field of Classification Search ..... 40/606.01, 40/607.01, 612, 607.1; 404/6, 9; 116/63 R; 49/49; 248/370
See application file for complete search history.

(56) References Cited

U.S. PATENT DOCUMENTS 5,468,093 A * 11/1995 Voigt ..... 404/6
6,019,543 A * 2/2000 Junker ..... 404/10
6,416,248 B1 * 7/2002 Clark ..... 404/10
6,739,567 B1 * 5/2004 Curtis ..... 248/548

FOREIGN PATENT DOCUMENTS

RU 2 100 547 * 3/1996

* cited by examiner

*Primary Examiner*—Gary S. Hartmann
(74) *Attorney, Agent, or Firm*—Connolly Bove Lodge & Hutz LLP

(57) ABSTRACT

A bollard for mounting to a foundation includes a bollard post element having a cavity therein with a base plate integrally fixed about its periphery to the bollard post element at the cavity. The base plate includes anchor holes and threaded holes extending therethrough. Levelers having threaded shafts with pads on one end and drivers on the other engage the threaded holes. Threaded anchor shafts extendible through the anchor holes and fixable to the foundation for the bollard are drawn in tension by nuts on top of the based plate. This simultaneously places the levelers in compression. In installation, the highest point on the foundation beneath the periphery of the base plate is established and the levelers adjusted to extend the bollard vertically with the bollard extending from that highest point.

7 Claims, 4 Drawing Sheets

BOLLARD AND METHOD OF MOUNTING

BACKGROUND OF THE INVENTION

The field of the present invention is bollards and the mounting thereof.

Bollards come in a great variety of sizes, shapes and capabilities. Mountings for such devices also are accomplished by a variety of means. Bollards can be fixed or retractable. There are heavy duty bollard designs with the bollard fully extending into a foundation. Lighter duty bollards are mounted to a base fixed to an anchor associated with a foundation. A full range of aesthetics from strictly utilitarian to architecturally responsive are employed.

Typical lighter duty bollards use a base casting separately installed and able to receive a bollard tube. Such castings must be installed separately from the bollard. Anchor holes extending through the casting receive threaded anchor shafts. The casting rests upon bottom nuts associated with the threaded anchor shafts before positioning of the casting. Once the casting is positioned, top nuts are installed to draw down the casting into a compressed state between the top and bottom nuts on ach threaded anchor shaft. Adjustments to the bottom nuts provide for vertical orientation of the casting. The top nuts then hold the casting in place. A bollard cap or tube is then fastened to the casting, typically by set screws.

The foregoing mounting of castings to support bollards is time consuming and inconvenient. The mounting must be disassembled substantially to provide for adjusting the vertical orientation. Further, there is no preloading aside from the short portion of the threaded anchor shaft between top and bottom nuts. Without preloading beyond the top and bottom nuts, no amount of tightening will impact on the stability of the mount. Further, additional adjustment to vertically lower the final position of the bollard relative to the foundation results in compounding the difficulty of adjustment.

SUMMARY OF THE INVENTION

The present invention is directed to a bollard for mounting to a foundation and a method for mounting such bollards. A bollard post element of the type including a cavity therein includes a base plate integrally fixed about its periphery to the bollard post element at the cavity. The base plate includes anchor holes and threaded holes extending through the plate. Levelers threadably mounted to the base plate with pads at one end and drivers at the other extend from the base plate to support the bollard. Conventional threaded anchor shafts extend through the base plate to receive nuts such that the threaded anchor shafts are maintained in tension while the levelers are maintained in compression with the bollard installed on the foundation. A hand-hole to the cavity may be employed to access threaded anchor shafts for receipt of the nuts and for adjustment of the levelers through manipulation of the drivers.

The method of installing such bollards includes determining through measurement or empirical observation the highest point of the foundation under the perimeter of the bollard base. Adjustments to the levelers may then be effected through manipulation of the drivers such that the bollard post element extends to the foundation at the highest point and extends vertically. The threaded nuts may then be associated with the threaded anchor shafts to draw the threaded anchor shafts into tension and to place the levelers in compression for final installation.

Accordingly, it is an object of the present invention to provide improved bollard mounting and method for bollard mounting. Other and further objects and advantages will appear hereinafter.

DETAILED DESCRIPTION OF THE PREFERRED EMBODIMENT

Figure 1:
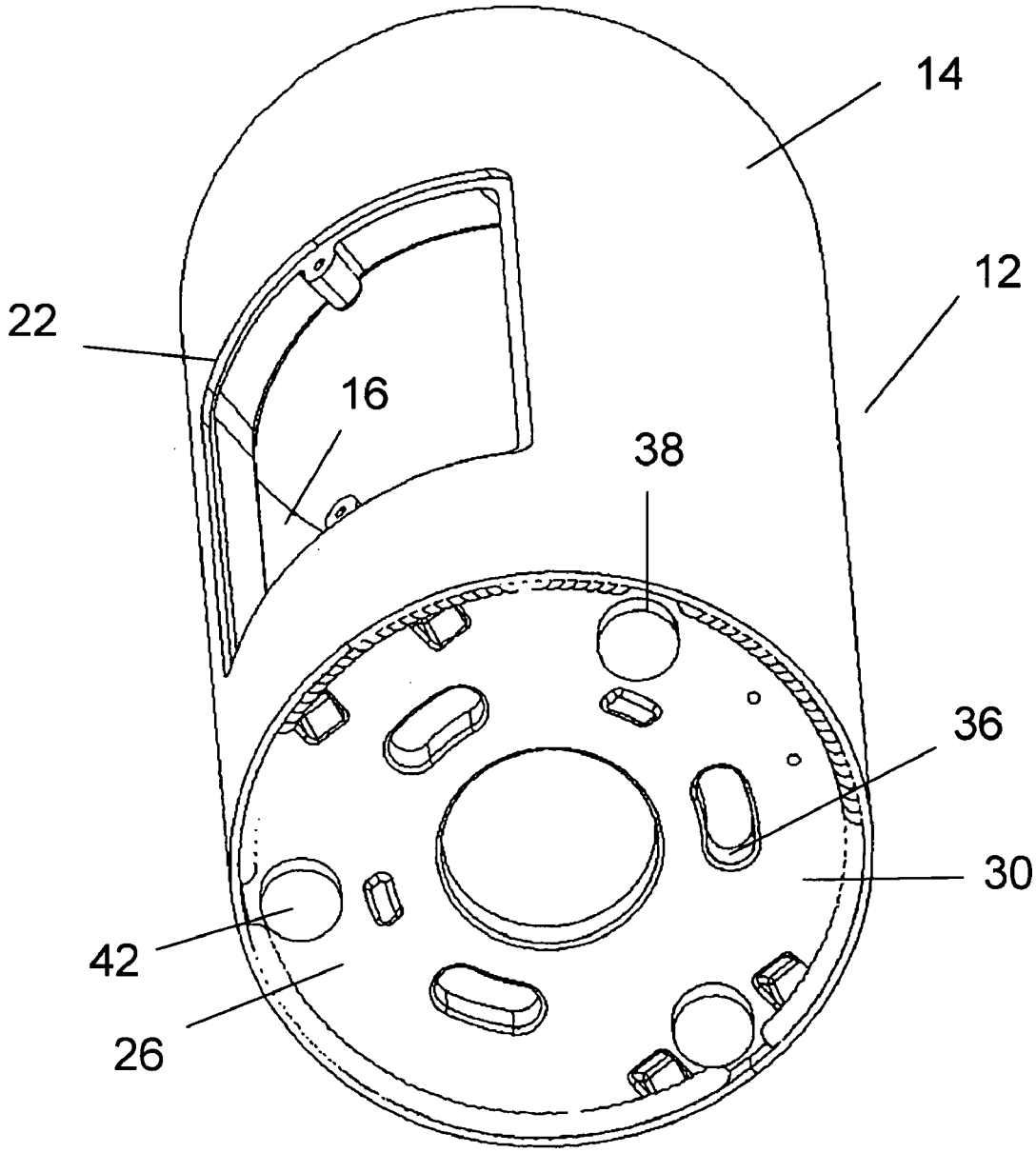
FIG. 1 is a perspective bottom view of a bollard with a base plate.
Figure 2:
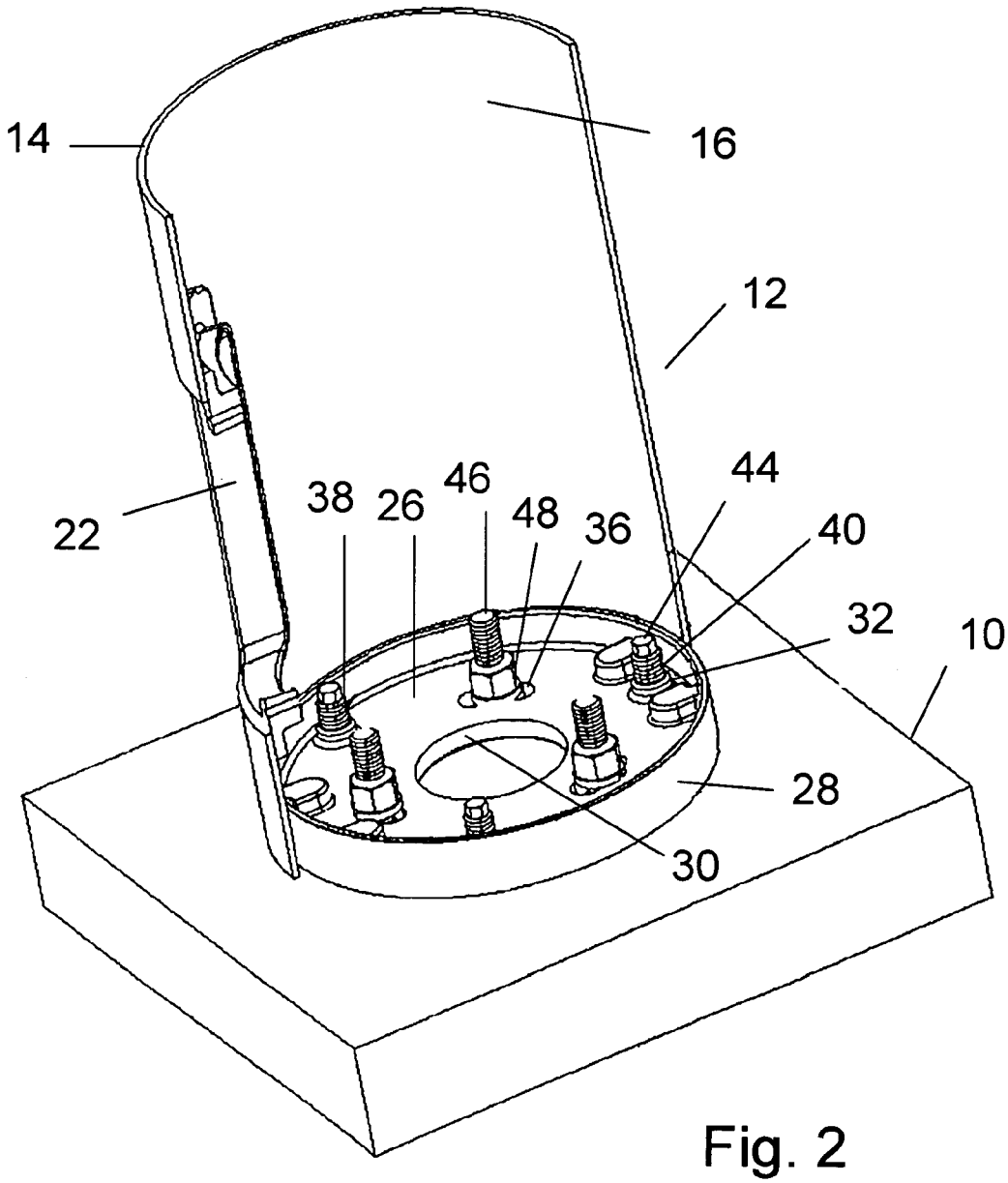
FIG. 2 is a perspective top view of the bollard of FIG. 1 with a portion of the bollard post element cut away for increased illustration.
Figure 3:
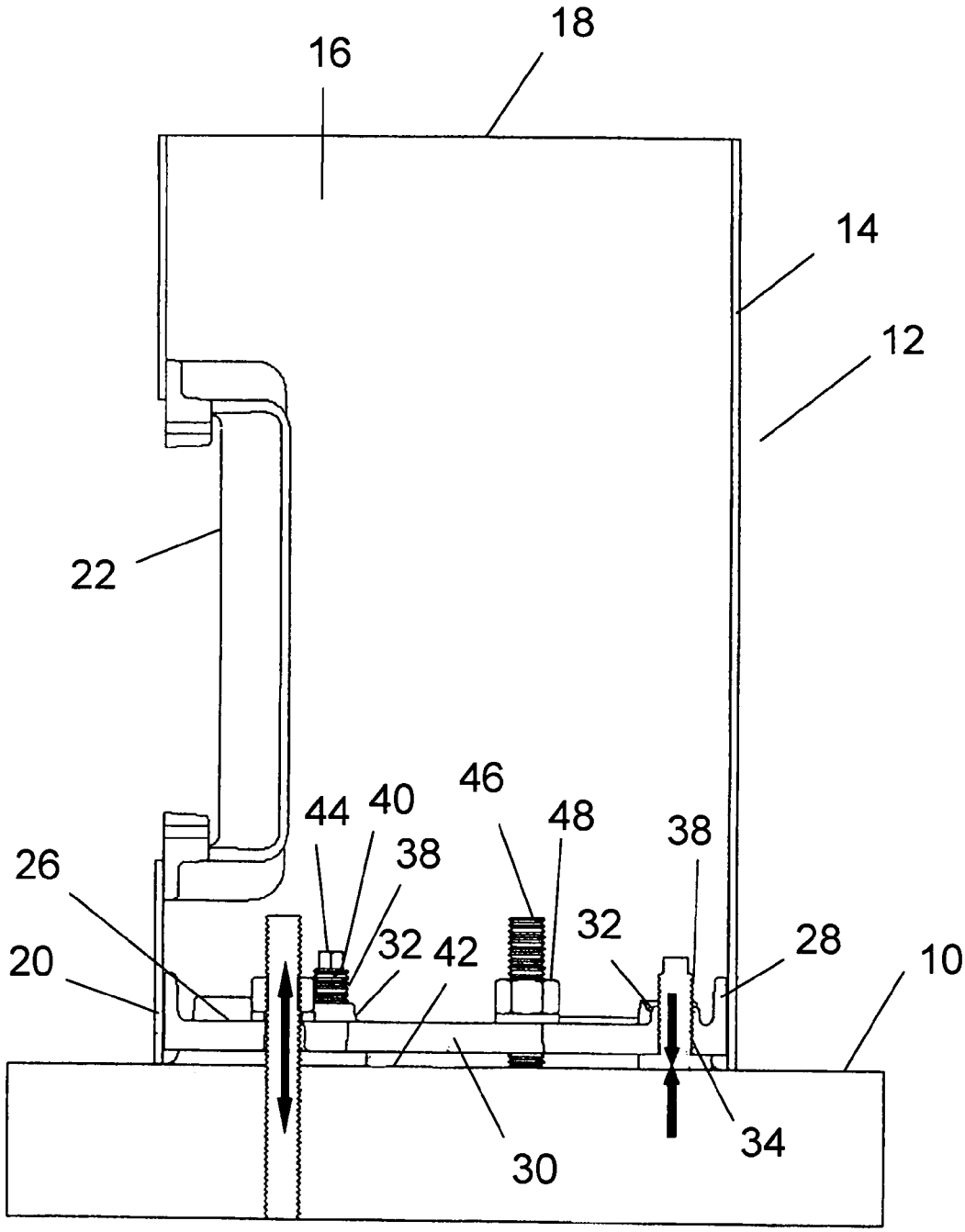
FIG. 3 is a cross-sectional side view of the bollard of FIG. 1.
Figure 4:
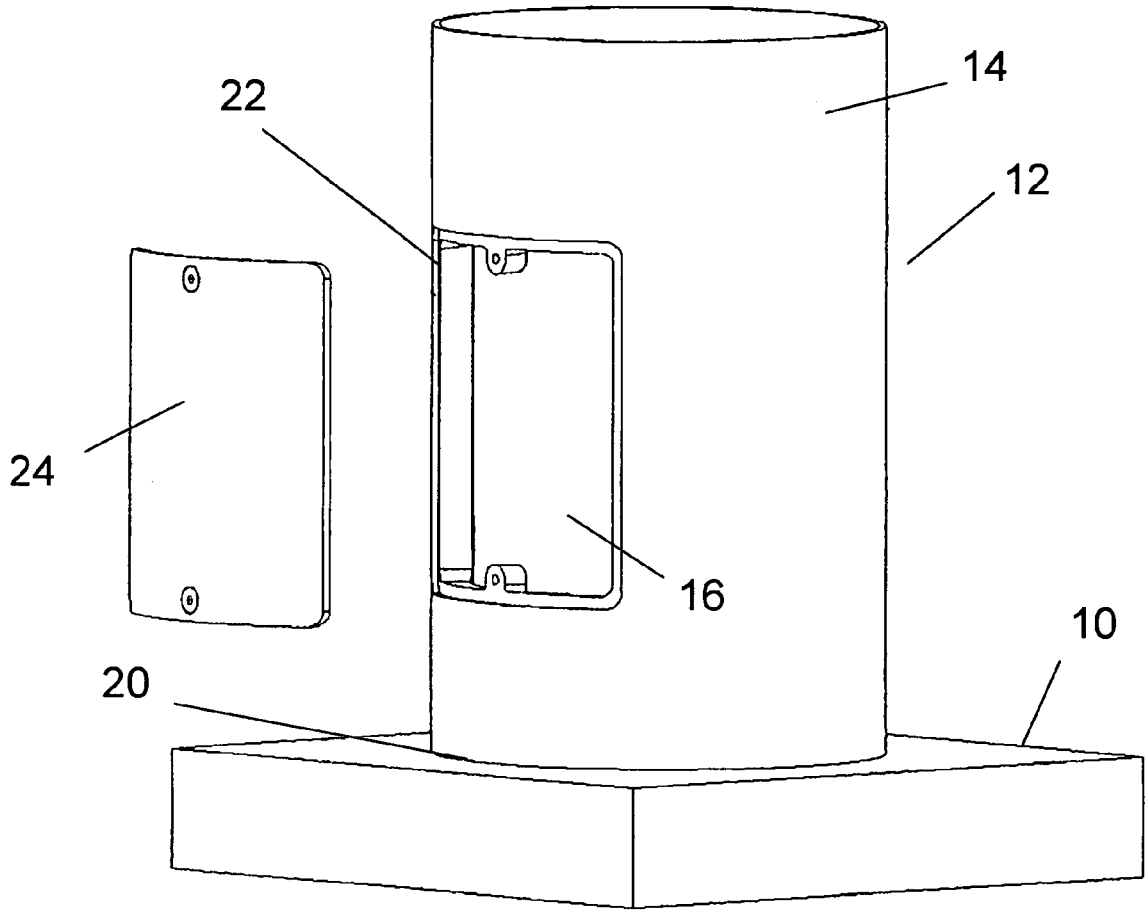
FIG. 4 is a perspective side view of the bollard of FIG. 1 with a hand-hole cover illustrated in exploded assembly.

Turning in detail to the drawings, a foundation 10 is schematically illustrated. The foundation is typically concrete which is poured with threaded anchor shafts placed in situ where bollards are to be erected. The configuration of the concrete, of course, will typically be dictated by many considerations beyond that of bollard support. However, an appropriate thickness is contemplated to properly fix and retain threaded anchor shafts for mounting the bollards.

A bollard, generally designated 12, is associated with the foundation to define a rigid structure operating as a barrier or standard. A bollard post element 14 is illustrated as including a cylindrical wall defining a cavity 16 therein. The bollards 12 which are shown include truncated bollard post elements 14 but which typically are of full height and are typically closed at the top. The bollard post element 14 includes a top end 18 and a base end 20. At the base end 20, a hand-hole 22 is open to the cavity 16. A hand-hole cover 24 seals the interior of the post element 14 at the base end 20.

A base plate 26 is integrally fixed, typically by means of welding, about its periphery to the bollard post element 14. The base plate 26 includes a cylindrical side wall 28 about the periphery of a generally flat plate 30. Bosses 32 create increased height about threaded holes 34. Three such threaded holes 34 are illustrated. Three anchor holes 36 also extend through the base plate 26. The threaded holes 34 and anchor holes 36 alternate and are equiangularly placed about the circular plate 30. The base plate 26 is shown welded to the bollard post element 14 on the underside.

Levelers 38 are threaded through the threaded holes 34. These levelers 38 include a threaded shaft 40 with a pad 42 on one end and a driver 44 on the other. The drivers 44 are shown to be hex studs for receipt of a socket wrench or the like. The pads extend outwardly of the base plate 26 to engage the foundation 10. The pads are of increased diameter over the threaded shafts 40 to reduce pressure and increase stability on the supporting surface.

The anchor holes 36 receive threaded anchor shafts 46 which are fixable in the foundation prior to assembly of the bollard. The anchor holes 36 are shown to be oblong to accommodate some variation in placement of the threaded anchor shafts 46. The shafts 46 extend through the anchor holes 36 without engaging the base plate 26. Nuts 48 are threaded onto the anchor shafts 46 to capture the base plate 26. The nuts 48 and associated washers, if employed, span the width of the anchor holes 36 to engage the base plate 26.

For installation, a foundation 10 is typically formed with concrete with the threaded anchor shafts 46 placed in situ before pouring the foundation 10. The integrally associated bollard post element 14 and base plate 26 is then placed over the threaded anchor shafts 46 with the threaded anchor shafts 46 extending through the anchor holes 36 in the base plate 26. The levelers 38, previously assembled with the base plate 26 are then adjusted by means of wrenches employed on the drivers 44. Upon initial placement with the levelers 38 withdrawn toward the base plate 26, the angle from vertical and the highest point of the foundation beneath the periphery of the base plate 26 can be determined. The levelers 38 are then threaded outwardly until the pads 42 contact the foundation 10. Leaving the bollard as close as possible to the foundation at the highest point, the levelers 38 are used to align the bollard with vertical. The nuts 48 are then tightened on the anchor shafts 46 to draw the anchor shafts 46 into tension. As a result, the levelers 38 are placed in compression with the tension and compression stabilizing the bollard mount.

Accordingly, an improved bollard mount and method of assembly are here disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A bollard for mounting to a foundation, comprising a bollard post element including a cavity therein;

a base plate fixed about its periphery to the bollard post element at the cavity and including anchor holes and threaded holes extending through the base plate;

levelers each including a threaded shaft with a pad at one end and a driver at the other end, the threaded shafts being threadably engaged through the threaded holes, the drives extending into the cavity;

threaded anchor shafts extendable through the anchor holes and fixable in the foundation; and nuts on the threaded anchor shafts for maintaining the threaded anchor shafts in tension and the levelers in compression with the bollard post element installed on the foundation.

2. The bollard of claim 1, the bollard post element being closed at the end opposite the base plate and further including a hand-hole accessing the cavity.

3. The bollard of claim 2, the drivers and the nuts being accessible through the hand-hole.

4. The bollard of claim 1, there being at least three levelers equiangularly spaced.

5. The bollard of claim 1, there being three levelers and alternately three anchor holes equiangularly spaced.

6. A method for mounting a bollard of claim 1, comprising anchor the threaded anchor shafts in the foundation;

place the bollard post element with the threaded anchor shafts through the anchor holes;

determine the highest point of the foundation under the perimeter of the base;

adjust the levelers using the drivers to have the bollard post element extend to the foundation at the determined highest point and to have the bollard post element extending vertically;

tighten the nuts on the threaded anchor shafts to place the threaded anchor shafts in tension and the levelers in compression.

7. A method for mounting a bollard of claim 3, comprising anchor the threaded anchor shafts in the foundation;

place the bollard post element with the threaded anchor shafts through the anchor holes;

determine the highest point of the foundation under the perimeter of the base;

adjust the levelers through the hand-hole using the drivers to have the bollard post element extend to the foundation at the determined highest point and to have the bollard post element extending vertically;

tighten the nuts on the threaded anchor shafts through the hand-hole to place the threaded anchor shafts in tension and the levelers in compression;

close the hand-hole.

* * * * *